US006835055B2

(12) United States Patent
Stellnert

(10) Patent No.: US 6,835,055 B2
(45) Date of Patent: Dec. 28, 2004

(54) ROTARY VANE VACUUM PUMP HAVING A ROTOR AXIAL SEAL AND AN AXIALLY BIAS ROTOR-DRIVE SHAFT COMBINATION

(75) Inventor: Mats Stellnert, Farsta (SE)

(73) Assignee: Delaval Holding AB, Tumba (SE)

( * ) Notice: Subject to any disclaimer, the term of this patent is extended or adjusted under 35 U.S.C. 154(b) by 11 days.

(21) Appl. No.: 10/343,198

(22) PCT Filed: Aug. 29, 2001

(86) PCT No.: PCT/SE01/01835

§ 371 (c)(1),
(2), (4) Date: Jan. 29, 2003

(87) PCT Pub. No.: WO02/18791

PCT Pub. Date: Mar. 7, 2002

(65) Prior Publication Data

US 2004/0013554 A1 Jan. 22, 2004

(30) Foreign Application Priority Data

Aug. 31, 2000 (SE) ..... 0003075

(51) Int. Cl.[7] ..... F04C 18/344; F04C 27/00; F04C 29/02

(52) U.S. Cl. ..... 418/141; 418/81; 418/99; 418/259; 418/265

(58) Field of Search ..... 418/77, 80, 81, 418/99, 107, 141, 259, 265

(56) References Cited

U.S. PATENT DOCUMENTS

| | | | | |
|---|---|---|---|---|
| 901,258 A | | 10/1908 | Pingret | 418/141 |
| 2,098,652 A | | 11/1937 | Buckbe | 418/133 |
| 2,312,655 A | | 3/1943 | Lauck | 418/133 |
| 2,400,286 A | * | 5/1946 | Buckbee | 418/141 |
| 2,731,920 A | * | 1/1956 | Scognamillo | 418/265 |
| 2,856,120 A | | 10/1958 | Fawzi | 418/141 |
| 3,399,826 A | * | 9/1968 | Andriulis | 418/99 |
| 3,804,562 A | * | 4/1974 | Hansson | 418/107 |
| 4,012,180 A | | 3/1977 | Berkowitz et al. | 418/141 |
| 4,397,620 A | | 8/1983 | Inagaki et al. | 418/141 |
| 5,571,004 A | * | 11/1996 | Masters et al. | 418/107 |

FOREIGN PATENT DOCUMENTS

| | | | | |
|---|---|---|---|---|
| DE | 1003388 | * | 2/1957 | 418/141 |
| DE | 2061385 | * | 6/1972 | 418/259 |

* cited by examiner

*Primary Examiner*—John J. Vrablik
(74) *Attorney, Agent, or Firm*—Harness, Dickey & Pierce, P.L.C.

(57) ABSTRACT

A vacuum pump of the rotary vane type, comprises a casing (50) having a cylindrical inner wall surface (52), a first (54; 54') and a second (56; 56') end wall at opposite sides of said casing defining a fluid cavity therein, fluid inlet (60) and outlet (62) ports in open communication with said fluid cavity, and a rotor (64; 64') extending between said end walls carried by a drive shaft (70) for rotation about an axis eccentric to said casing inner wall surface, said rotor being provided with a plurality of longitudinally extending radial slots (66) about the periphery thereof. Further, there are provided a plurality of vanes (68), each being radially slidably carried within a respective of said slots. The invention comprises that at least one of said end walls and said rotor comprise, at oppositely facing surfaces, an annular recess (84, 86; 84', 84", 86', 86") and an annular rib (88, 90; 88', 88", 90', 90"), respectively, said rib and recess being interengaging so as to define a radial clearance (92, 96; 92', 96') and an axial seal (94, 98; 94', 98'), respectively, between said at least one of said end walls and said rotor, and that the rotor/drive shaft combination is axially biased.

16 Claims, 6 Drawing Sheets

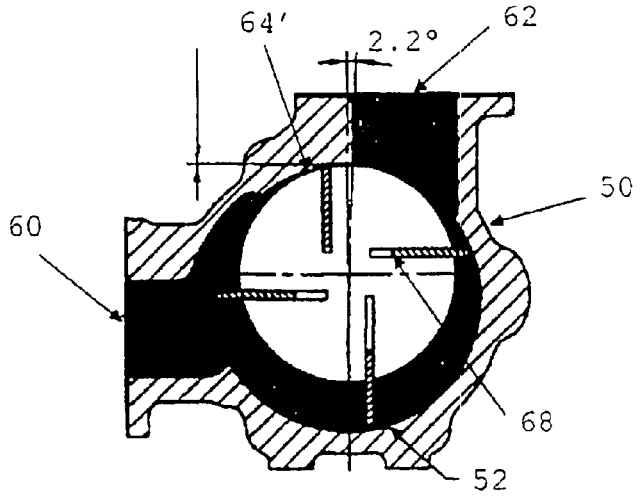
Fig. 3c
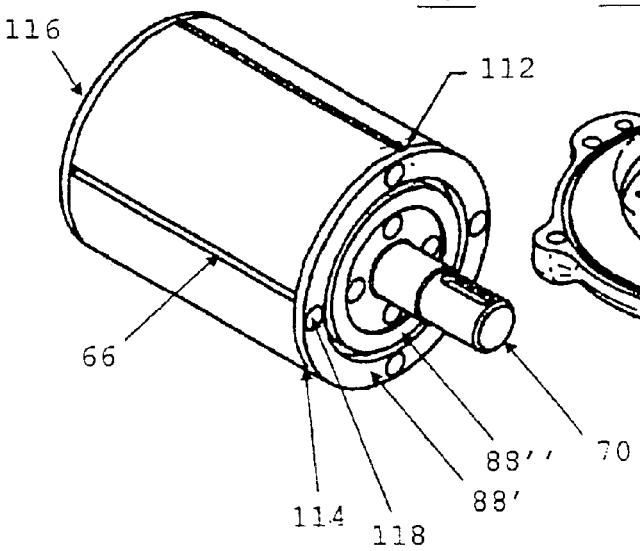
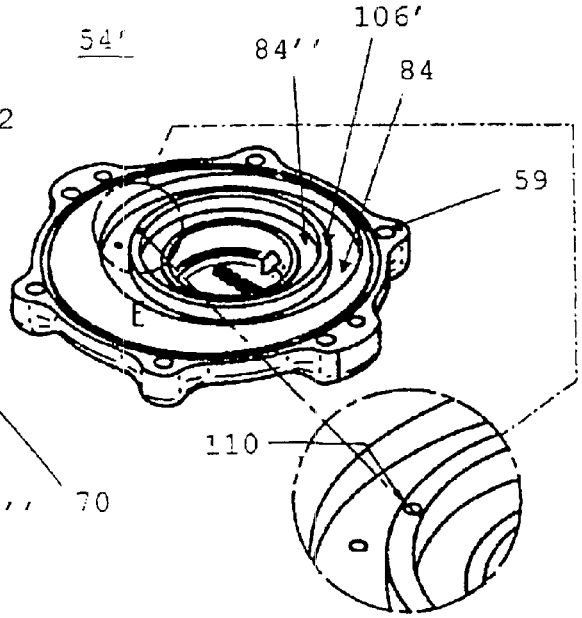
Fig. 3d
Fig. 3e

ROTARY VANE VACUUM PUMP HAVING A ROTOR AXIAL SEAL AND AN AXIALLY BIAS ROTOR-DRIVE SHAFT COMBINATION

The present invention generally relates to vacuum pumps, and more specifically to the kind of device in which a plurality of vanes are fitted to slide substantially radially in a respective slot of a rotor eccentrically mounted within a casing.

DESCRIPTION OF RELATED ART AND BACKGROUND OF THE INVENTION

A previously known vacuum pump of such kind is illustrated in FIGS. 1*a–e*. The pump includes a cylindrical-shaped casing or housing 10 which has an inner cylindrical wall surface 12 and is closed at its opposite ends by end walls 14, 16 such as by means of machine screws 18 or the like. As shown, the pump includes circumferentially spaced fluid input 20 and output 22 ports intercommunicating the interior cavity. Output 22 is preferably held at atmospheric pressure, while input 20 is held at a vacuum of about 50 kPa during operation.

The rotor 24 of the pump is provided with a number of elongated vane slots 26 cut therein from the circumference thereof; and wherein a plurality of vanes 28 are mounted in freely slidable relation within these slots. A pump drive shaft 30, provided with an axle spindle 32 for coupling, is keyed to the rotor 24 and is rotatably mounted in the end walls 14, 16 as by means of bearings 32, 34. The rotor 24 is eccentrically mounted relative to the cylindrical inner wall 12 of the casing 10. Accordingly, for efficient operation of a pump of this type, as the rotor turns within the casing it is required for the outboard edges of the vanes 28 to be in pressure-sealing contact with the inner surface 12 of the casing 10 while sliding in slots 26 back and forth; and that pressure losses around the longitudinal ends of vanes 28 and rotor 24 permitting escape of fluid to the exhaust, must also be prevented.

To such end, the pump comprises radial seals 35, 36 between the rotor 24 and the end walls 14, 16, respectively, and also between the vanes 28 and the end walls 14, 16. The rotor is not axially locked, but is freely movable between the end walls, in order not to exhibit unacceptable losses caused by e.g. axial slackness of the ball bearings and manufacturing tolerances of the pump components. Due to such freely movable mounting, however, the pump is very sensitive to axial forces and in unfortunate situations such forces may lead to seizing of the pump. Additionally, such radial seals need large amounts of evenly distributed lubrication in order to work satisfactorily and very precise clearances 38, 40 of the seals 35 and 36, respectively, have to be provided and maintained irrespective of variations in the temperature of the pump. This may be hard to fulfill due to different length expansions of casing 10 and rotor 24.

The latter problem has been addressed in the art. For instance, U.S. Pat. No. 2,312,655 issued to LAUCK discloses a rotary impeller type of vacuum pump, which provides for a precise clearance between the walls and the adjacent impeller assembly irrespective of the materials of the housing and of the impeller assembly. The pump includes the main housing of a light weight material, the impeller assembly of a heavier material, and an intermediate housing assembly, being composed of a thin sleeve member of a material having substantially the same characteristic temperature expansion as the heavier material of the impeller assembly, an axially adjustable end plate, and a plurality of coil springs. The thin sleeve member is arranged between the main housing and the impeller assembly and has a length slightly greater than the overall coaxial dimension of the impeller assembly by an amount exactly equal to the desired total clearance to be provided. The end plate is arranged to engage at the periphery thereof with the end of the sleeve member and urging the same into such engagement by means of the plurality of coil springs. In such manner the initially provided clearance is maintained irrespective of the differential temperature expansion between the housing and the impeller assembly.

U.S. Pat. No. 2,098,652 issued to BUCKBE discloses a similar type of vacuum pump provided with annular members arranged in spaces provided between the rotor-vane combination and the casing heads of the pump. These annular members are maintained pressed against the end surfaces of the rotor-vane combination by means of directing a suitable pressure fluid against the annular members, preferably between annular recesses of the annular members and the casing heads, such that they are forced to rotate with the rotating rotor-vane combination. The longitudinal dimensions are set such that there will always be a clearance between the rotating parts and the casing heads. Further, the annular members and the casing heads are provided with a number of interengaging annular ribs as a further means of preventing internal leakage.

However, such vacuum pumps comprise additional parts, which make them more complicated and costly to fabricate. Further, the former pump needs provision of a plurality of coil springs, and it does not provide for maintenance of the radial clearance if there are spatial temperature gradients, such as if the impeller was to be more heated than the sleeve member. The latter pump needs the provision of a pressure fluid and seals to prevent such pressurized fluid from leaking into the low pressure pump chamber. Additionally, there are extensive frictional movements between the vanes and the annular members, as these members are pressed against the vanes, while the vanes are sliding substantially radially within their respective slots continuously.

Further, U.S. Pat. No. 4,397,620 issued to INAGAKI et al. discloses a rotary compressor including disc-shaped members having a diameter slightly smaller than that of a rotor each disposed on opposite ends of the rotor and supported on the same rotary shaft as the rotor for rotation, and two disc-shaped recesses each formed on one of inner opposite end surfaces of a housing for receiving therein one of the rotary disc-shaped members. A small gap is formed between the inner end surfaces of the housing and the end surfaces of the rotor, and small gaps are formed between surfaces of the rotary disc-shaped members and surfaces of the disc-shaped recesses.

However, such pump is not suitable to be used with a coupling, which generates axial forces since the pump then may seize. Further, the pump may be noisy and the bearings used may be exposed to stress, and thus have a short lifetime. Also, it is doubtful if the pump may withstand its own weight, and maintain the radial gaps if mounted on a support which is not horizontal.

SUMMARY OF THE INVENTION

It is an object of the present invention to provide a vacuum pump of the rotary vane type, which is in lack of the problems discussed above in connection with vacuum pumps of the prior art.

It is yet a further object of the invention to provide such a vacuum pump that is efficient, simple, reliable, of low cost, and easy to manufacture.

It is still a further object of the invention to provide such a vacuum pump that allows for axial biasing of the rotor.

These objects among others are, according to the present invention, attained by vacuum pumps as claimed in the appended claims.

By providing the rotor and the end walls at oppositely facing surfaces, by annular recesses and annular ribs, respectively, wherein the ribs and the recesses are interengaging so as to define radial clearances and axial seals, respectively, between the end walls and the rotor, a pump is obtained, which provides for a clearance between the rotor and end walls irrespective of the materials thereof or any temperature gradients, while the pump is simple and reliable and has very few movable parts. Very same end walls may be used in a large variety of pumps having different pump capacities.

The rotor and the end walls may be provided with a plurality of annular recesses and ribs, respectively, such that axial labyrinth seals between the end walls the said rotor are obtained. In such manner any leakages occurring, are further reduced.

By axially biasing the rotor/drive shaft combination of the vacuum pump, preferably by means of axial stops provided in the end walls and a loaded spring, e.g. a cup spring, mounted between the rotor and the axial stops, a vacuum pump, which is insensitive to axial forces is obtained. In such instance, a plurality of different transmission systems or gearboxes may be used with the vacuum pump. Further, an axially biased pump is easier to manufacture, and the pump may be mounted upon a support, which is not horizontal.

Bearings, such as ball bearings, in which the rotor/drive shaft combination may be mounted at the end walls would have a longer lifetime, be less noisy and cause less vibrations, when being axially biased. Further, the radial and axial plays of the bearings would not affect the sealing properties of the inventive vacuum pump.

Further, by providing the end walls with a respective inner annular rib for axially guiding the vanes when sliding substantially radially within the slots of the rotor, it is prevented that vanes may move sideways and get stuck at the inner corners of the end walls. Additionally, each of the inner annular ribs may be provided with a respective through hole for lubrication of the vanes.

By providing a rotor wherein the longitudinally extending radial slots are at least partly, or completely, radially sealed at the longitudinal ends thereof, the internal leakage is even further reduced. Hereby, the casing and the end wall located at the motor side, may be an integrated single part.

Further characteristics of the invention and advantages thereof will be evident from the following detailed description of embodiments of the invention.

BRIEF DESCRIPTION OF THE DRAWINGS

The present invention will become more fully understood from the detailed description of embodiments of the present invention given hereinbelow and the accompanying FIGS. 1–3, which are given by way of illustration only, and thus are not limitative of the present invention.

FIG. 3*c* is a radial cross sectional view of the vacuum pump embodiment of FIG. 3*a*.

FIG. 3*d* displays, in a perspective view, an inventive rotor as being comprised in the vacuum pump embodiment of FIG. 3*a*.

FIG. 3*e* displays, in a perspective view, an inventive casing end wall, and also a fragmentary enlarged scale view of an encircled portion thereof, as being comprised in the vacuum pump embodiment of FIG. 3*a*.

DETAILED DESCRIPTION OF EMBODIMENTS

Figure 1A:
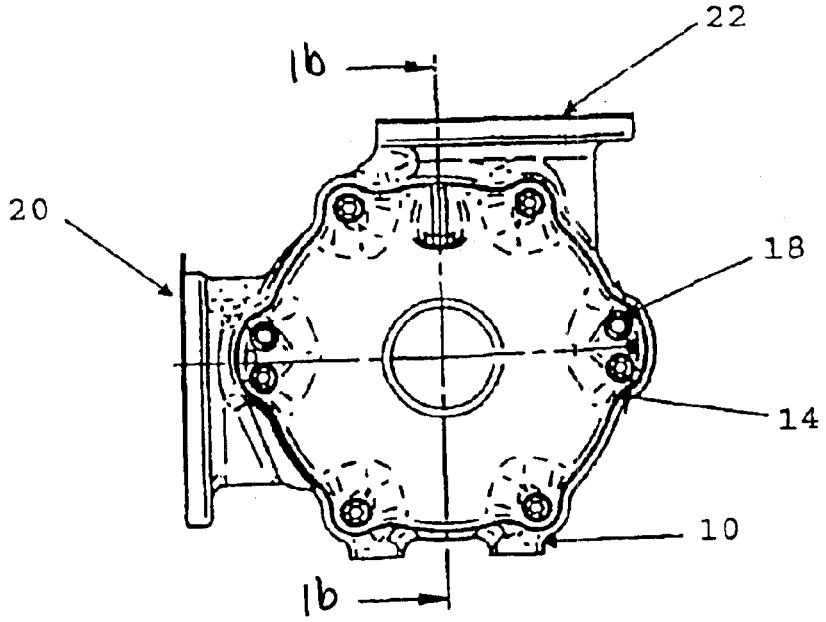
Fig. 1a PRIOR ART
FIG. 1*a* is a front elevation view of a vacuum pump of the rotary vane type according to prior art.
Figure 1B:
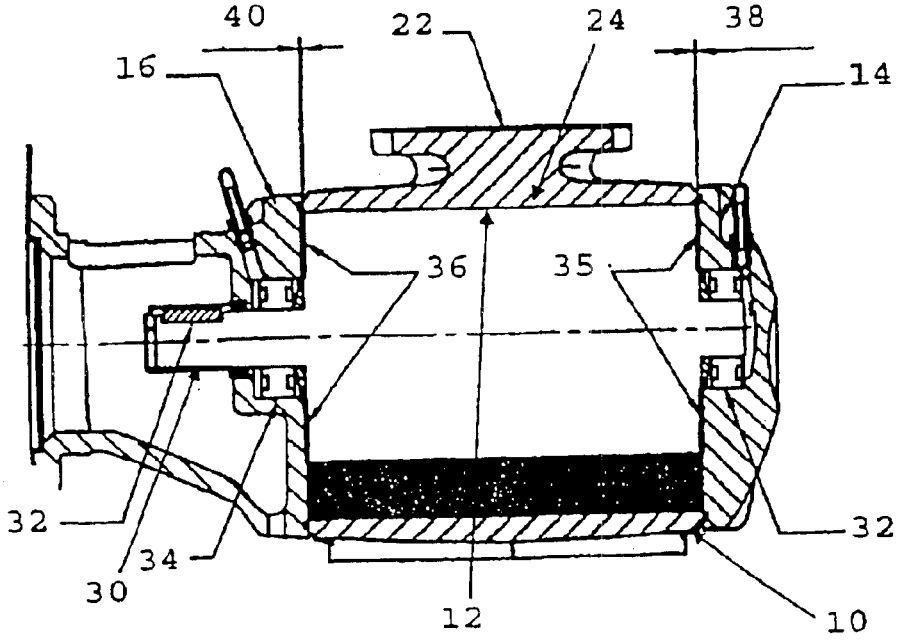
Fig. 1b PRIOR ART
FIG. 1*b* is a sectional view along the line 1*b*—1*b* of FIG. 1*a*.
Figure 1C:
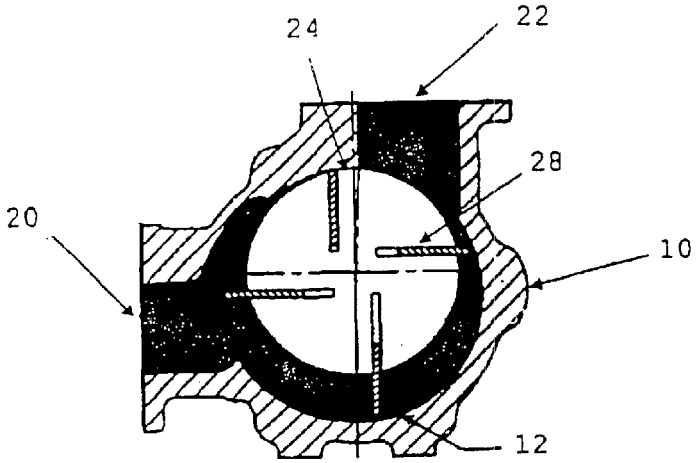
Fig. 1c PRIOR ART
FIG. 1*c* is a radial cross sectional view of the vacuum pump of FIG. 1*a*.
Figure 1D:
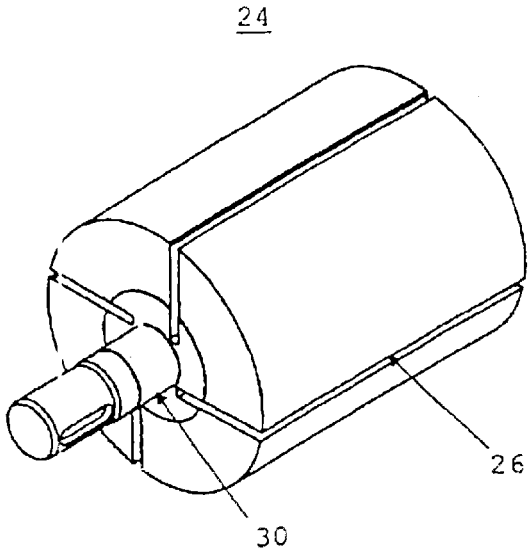
Fig. 1d PRIOR ART
FIG. 1*d* displays, in a perspective view, a rotor as being comprised in the vacuum pump of FIG. 1*a*.
Figure 1E:
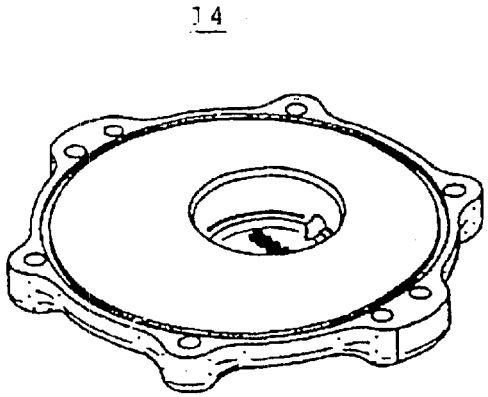
Fig. 1e PRIOR ART
FIG. 1*e* displays, in a perspective view, a casing end wall as being comprised in the vacuum pump of FIG. 1*a*.

In the following description, for purposes of explanation and not limitation, specific details are set forth, such as particular techniques and applications in order to provide a thorough understanding of the present invention. However, it will be apparent to one skilled in the art that the present invention may be practiced in other embodiments that depart from these specific details. In other instances, detailed descriptions of well-known methods and apparatuses are omitted so as not to obscure the description of the present invention with unnecessary details.

The vacuum pump of the present invention is primarily intended to be used with equipment such as an automatic milking machine and other equipment present at a dairy farm. Nevertheless, the pump may be suitable for use in other fields, and as far as the present invention concerns there is no limitation whatsoever as to where the pump may find applications.

With reference to FIGS. 2*a*–*e* a first exemplary embodiment of the vacuum pump of the present invention will be described.

The pump includes a cylindrical-shaped casing or casing 50, which has an inner cylindrical wall surface 52 and is closed at its opposite ends by end walls 54, 56 such as by means of machine screws 58 or the like, being received in holes 59 of end wall 54 and similar holes in the longitudinal end of casing 50. Similarly, end wall 56 is mounted to the opposite end of casing 50. As shown, end wall 56 is integrated in a larger detail 57 referred to as a motor axle casing to be mounted to a motor casing housing a motor 200 for driving the pump. Further, casing 50 includes circumferentially spaced apart fluid inlet 60 and outlet 62 ports intercommunicating the interior cavity of the pump.

The rotor 64 of the machine is provided with a number of elongated vane slots 66 cut therein on the radius thereof, and within these slots are mounted in freely slidable relation therein a plurality of vanes 68. The pump drive shaft 70 is press-fitted into the rotor 64 (or otherwise keyed thereto) and is rotatably mounted in the end walls 54, 56 as by means of bearings 72, 74. In an alternative version the rotor and the pump drive shaft are fabricated as a single unit. The bearings are preferably slide fitted to the end walls 54, 56, and interference fitted to the rotor/drive shaft combination 64, 70.

Figure 2A:
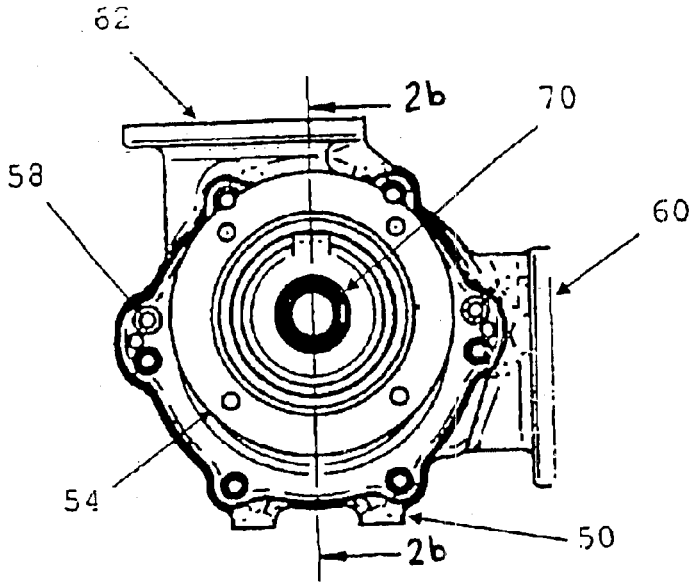
FIG. 2*a* is a front elevation view of a vacuum pump of the rotary vane type when its front-end wall is demounted according to a first embodiment of the present invention.
Figure 2B:
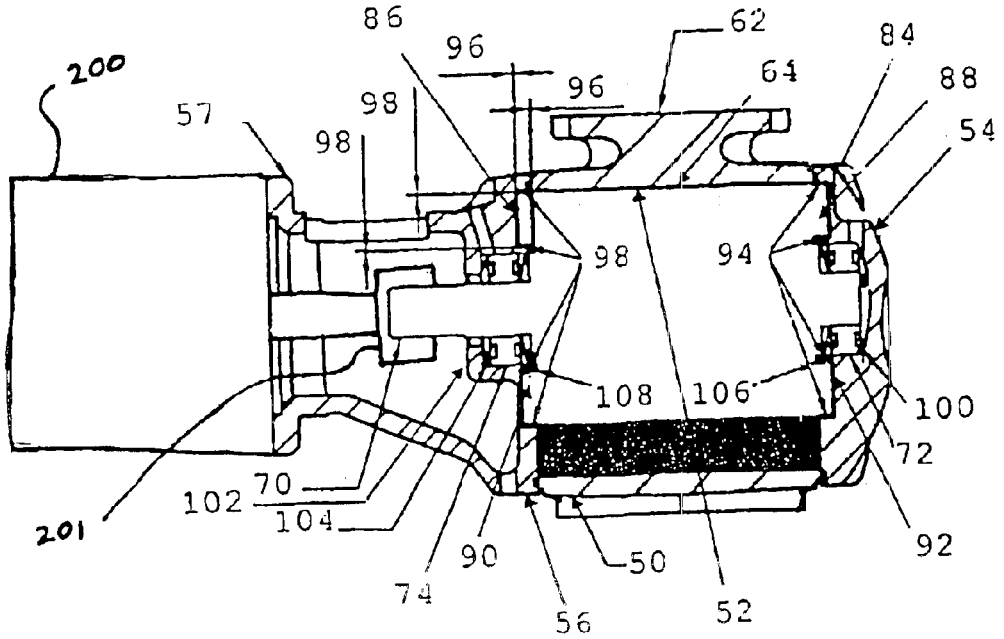
FIG. 2*b* is a sectional view along the line 2*b*—2*b* of FIG. 2*a*.
Figure 2C:
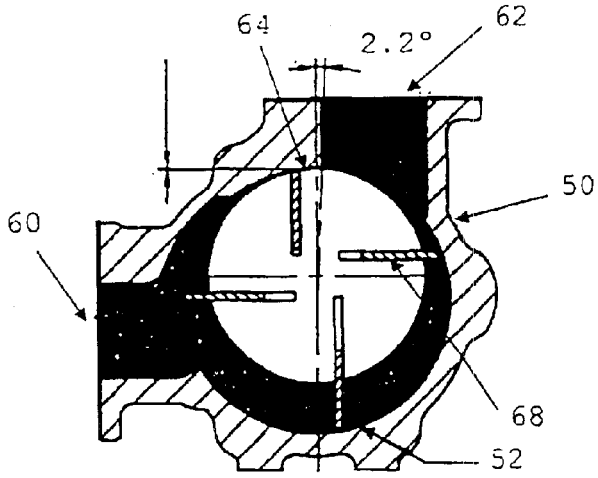
FIG. 2*c* is a radial cross sectional view of the vacuum pump embodiment of FIG. 2*a*.
Figure 2D:
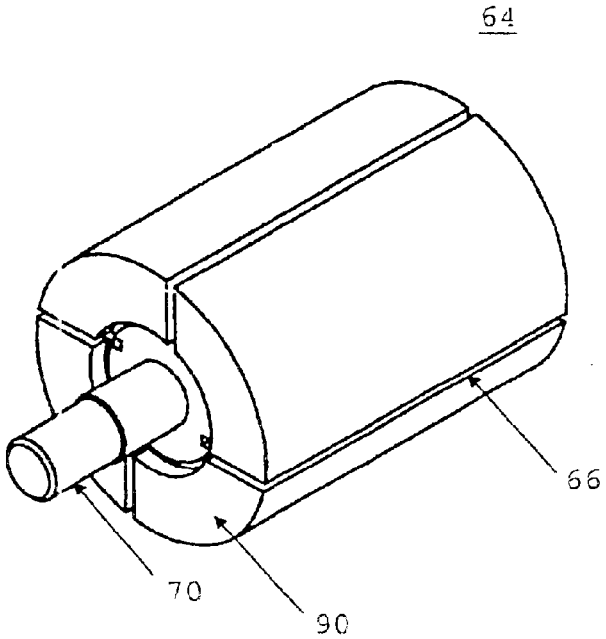
FIG. 2*d* displays, in a perspective view, an inventive rotor as being comprised in the vacuum pump embodiment of FIG. 2*a*.
Figure 2E:
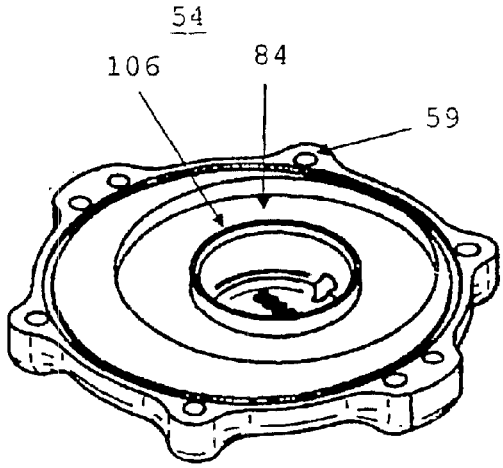
FIG. 2*e* displays, in a perspective view, an inventive casing end wall as being comprised in the vacuum pump embodiment of FIG. 2*a*.
Figure 3A:
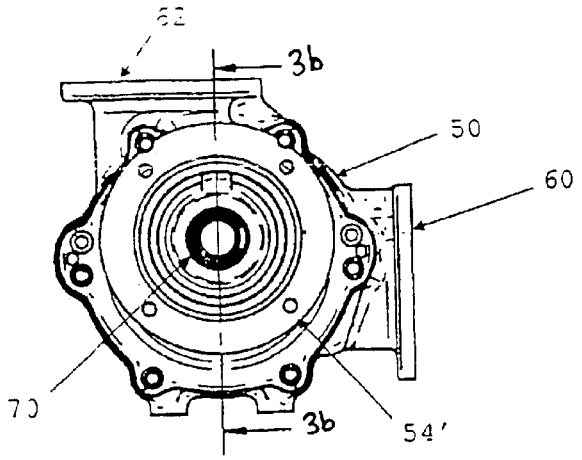
FIG. 3*a* is a front elevation view of a vacuum pump of the rotary vane type when its front-end wall is demounted according to a second embodiment of the present invention.
Figure 3B:
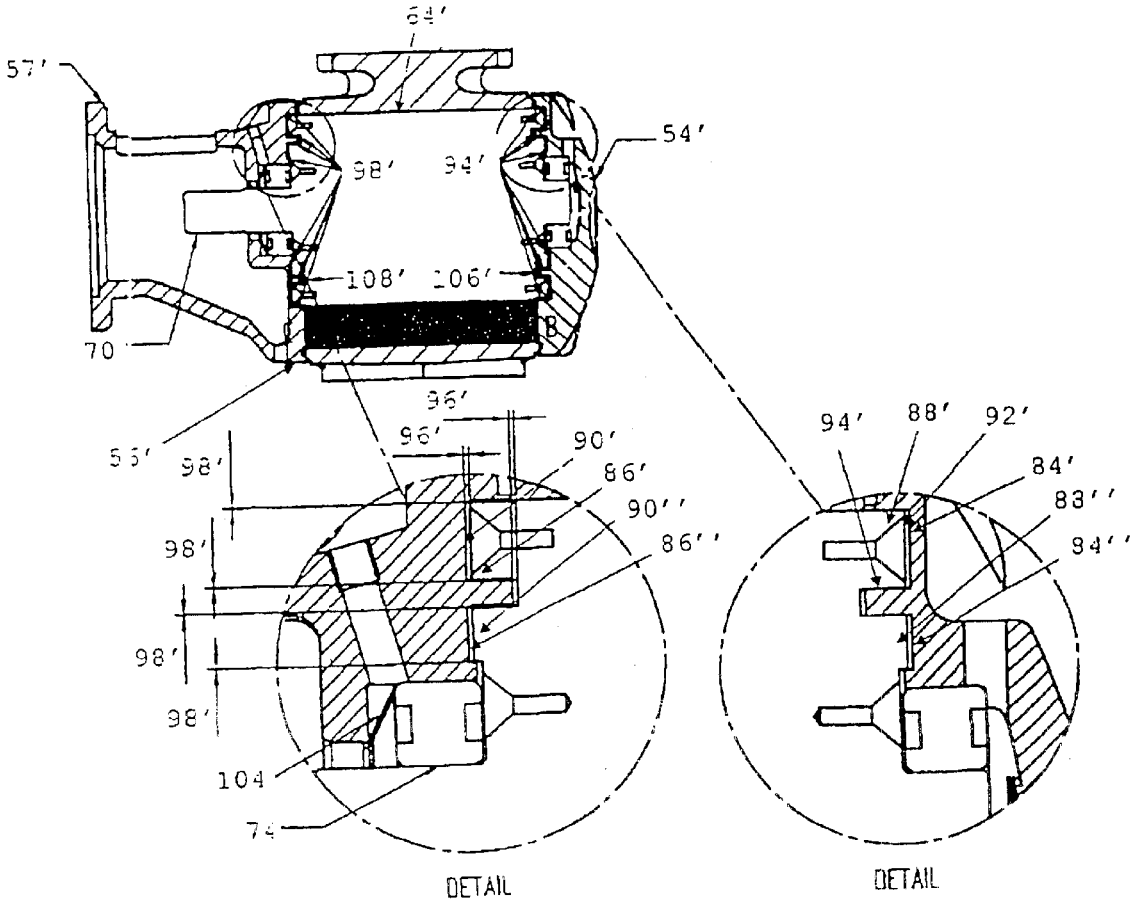
FIG. 3*b* is a sectional view along the line 3*b*—3*b* of FIG. 3*a*, in which also fragmentary enlarged scale views of encircled portions are shown.

The rotor 64 is concentrically mounted and positioned with respect to the axis of the drive shaft 70 as shown in FIG. 2*d*, but the shaft 70 is eccentrically mounted relative to the cylindrical inner wall 52 of the casing 50. Accordingly, it will be understood that for efficient operation of a machine of this type, as the rotor turns within the casing it is required for the outboard edges of the vanes 68 to be at all times in pressure-sealing contact with the inner surface 52 of the casing 50 while reciprocatively sliding in the slots 66; and that pressure losses around the ends of the vanes permitting escape of fluid to the exhaust, has also to be prevented.

To attain the aforesaid objectives, end walls 54, 56 are provided with annular recesses 84, 86 and the rotor 64 is provided with annular ribs 88, 90 at its respective end faces. Recess 84 and rib 88 are interengaging so as to define a radial clearance 92 and an axial seal 94, respectively, between end wall 54 and rotor 64. Similarly, recess 86 and rib 90 are interengaging so as to define a radial clearance 96 and an axial seal 98, respectively, between end wall 56 and rotor 64. It shall be appreciated in this respect that a radial clearance signifies a play between the rotor and the end walls, said play extending in the radial direction. Correspondingly, an axial seal signifies a thin slit or a gap between the rotor and the end walls, said thin slit or gap extending in the axial direction and operating as a seal between said parts.

The rotor/drive shaft combination 64, 70 (joined in fixed relation or fabricated as a single piece) is axially biased by means of axial stops 100, 102, respectively, provided in the end walls 54, 56 and a loaded spring, preferably a cup spring 104, mounted between rotor 64, or more precisely one of the bearings 74, and the axial stop 102 of end wall 56. In such manner the thermal expansion of rotor 64 is balanced by means of spring 104 in the direction of end wall 56 (i.e. on the motor side). Such axial biasing is very advantageous since it allows for the use of a coupling (not illustrated), which generates axial forces. Preferably then, the drive shaft 70 is provided with an axle spindle, to which the coupling 201 is mounted, and via which the motor 200 can drive the rotor/drive shaft combination 64, 70. Further, the use of axial biasing of the rotor/drive shaft combination 64, 70 provides for a more silent-running pump with a longer lifetime.

End walls 54, 56 comprise a respective inner annular rib or ring 106, 108 for axially guiding the vanes 68 when sliding substantially radially within said slots. This guiding rib guides the vanes from their innermost position (e.g. at startup) towards their outermost position without allowing them to move sideways and thus to possibly get stuck in the end walls 54, 56. Annular ribs or rings 106, 108 may further be provided with a respective through hole (not illustrated) for lubrication of the vanes.

The longitudinally extending radial slots 66 are in this embodiment preferably extending along the complete longitudinal extension of said rotor. The vanes 68 extend along the entire casing 50 and in this respect, an essentially radial sealing between vanes 68 and end walls 54, 56 is provided as in the prior art device of FIG. 1. However, vanes 68 are preferably made of a plastic or other low friction material, such that very small clearances between vanes 68 and end walls 54, 56 can be employed. The need of lubrication of the vanes may in such instances be dispensed with. Further, the material of vanes 68 is preferably chosen such that the thermal expansion of vanes 68 and of casing 50, respectively, are comparable. Further, vanes 68 are easily exchangeable simply by demounting end wall 54, drawing the vanes axially out of their respective slots, inserting new vanes, and finally remounting end wall 54.

Further notably, slots 66 are arranged not entirely radially, but parallelly translated therefrom, to be oriented in a radial-tangential direction. Such design is intended to be included in the expression "substantially radially" as used within the present patent application. Accordingly, vanes 68 are sliding in a substantially radial direction.

Advantages of this particular embodiment of the invention comprise:

- An axial sealing is not working as a sliding bearing, which indicates that no lubrication is needed between rotor and end walls.
- The location for lubrication of the vanes may be freely selected. Hence, the material of the vanes as well as the type of lubrication may be more freely selected. Possibly, the pump may be driven entirely without lubrication.
- The critical thermal expansion is now related to the diameter of the rotor and not to the length thereof. Thus, there are possibilities to manufacture pumps of longer lengths. Further, very same end walls may be used for both short and long vacuum pumps. Different material combinations for the casing, rotor, and end walls may be used with the risk of seizing reduced to a minimum.
- The axial biasing of the rotor/drive shaft combination enables the use of a coupling, which generates axial forces.
- The manufacturing will be easier due to less stringent tolerances.
- The pump may be located on a surface, which is inclined with respect to the horizontal plane.
- The axial biasing of the rotor/drive shaft combination will result in longer lifetimes of the ball bearings. Further, the bearings will cause less noise and less vibrations. The kind of bearings is more freely chosable and any radial and/or axial play of the bearings does not affect the sealing between the rotor and the end walls.

In FIGS. 3*a–e* a second exemplary embodiment of the present invention is shown. This second embodiment is similar to said second embodiment and all identical parts and features of the two embodiments are given identical reference numerals in the Figures. However, the second embodiment is differing from the first embodiment as regards the following.

End walls 54' and 56' are provided with respective first and second annular recesses 84', 84" and 86', 86", and rotor 64' is provided with respective first and second annular ribs 88', 88" and 90', 90" at each of its longitudinal end faces. Thus, annular recesses 84', 84" and 86', 86" and ribs 88', 88" and 90', 90" are interengaging so as to define radial clearances 92', 96' and a plurality of axial seals 94' 98', respectively, between end walls 54', 56' and rotor 64'. Thus, axial labyrinth seals are provided, which may further reduce the internal leakages of the pump.

End wall 56' is as in previous embodiment integrated in a motor axle casing 57'.

Annular ribs or rings 106', 108' as defined between respective annular recesses 84', 84" and 86', 86" are adapted to guide the vanes 68 axially when sliding substantially radially within the slots. Annular ribs or rings 106', 108' are further provided with a respective through hole (only through hole 110 in rib 106' is illustrated, FIG. 3*e*) for lubrication of the vanes. Preferably, vanes 68, fluid inlet port 60, and through hole 110 for lubrication, are arranged circumferentially such that there are, at all times during operation, at least one of the vanes 68 located between fluid inlet port 60 and the through hole 110 for lubrication. Thus, as through hole 110 never will be in open communication with inlet port 60 the internal leakages are further reduced.

Furthermore, the longitudinally extending radial slots 66 are at least partly, but preferably completely, radially sealed 112 at the longitudinal ends thereof, e.g. by means of sealing rings 114, 116 attached to the body of rotor 64' by means of screws 118 or other fastening means. Such sealing rings may extend along the entire radial extension of slots 66 as illustrated, or they may extend only partly along the radial extension of slots 66. Alternatively, the rotor 64' is made as a single piece with integrated radial seals.

Particular advantages of this latter embodiment comprise:

The internal leakage is further reduced.

A larger play between end walls and vanes may thus be acceptable, which facilitates the choice of vane material.

A larger "smallest distance" between the eccentrically arranged rotor 64' and the inner surface 52 of casing 50 may be acceptable. This would make it possible to manufacture end wall/motor axle casing 56', 57' and casing 50 integrated in a single piece.

Simpler manufacturing and logistics if tolerances are higher, fewer pieces are to be manufactured.

Simpler mounting if fewer pieces (integrated casing/end wall) are to be mounted.

No need of uniquely fastening end walls to casing by pins; the end walls are thus exchangeable.

Simple and even lubrication of the vanes, if at all necessary, through holes 110 provided in annular end wall ribs 106', 108'.

It will be obvious that the invention may be varied in a plurality of ways. Such variations are not to be regarded as a departure from the scope of the invention. All such modifications as would be obvious to one skilled in the art are intended to be included within the scope of the appended claims.

What is claimed is:

1. A vacuum pump of the rotary vane type comprising:

a casing having a cylindrical inner wall surface;

a first and a second end wall at opposite sides of said casing defining a fluid cavity therein;

fluid inlet and outlet ports in open communication with said fluid cavity;

a rotor extending between said end walls and fixedly carried by a drive shaft for rotation about an axis eccentric to said cylindrical inner wall surface, said rotor being provided with a plurality of longitudinally extending substantially radial slots about the periphery thereof; and a plurality of vanes, each being substantially radially slidably carried within a respective one of said slots, wherein at least one of said end walls and said rotor comprise, at oppositely facing surfaces, an annular recess and an annular rib, respectively, said rib and recess being interengaging so as to define a radial clearance and an axial seal, respectively, between said at least one of said end walls and said rotor;

said rotor/drive shaft combination is rotatably mounted on said end walls via bearings provided between said rotor and said end walls; and said rotor/drive shaft combination is axially biased via axial stops provided on sides of said first and second end walls which face said fluid cavity, and a loaded spring mounted between said rotor and the axial stop provided on the side of one of said end walls.

2. The vacuum pump of claim 1 wherein said spring is a cup spring.

3. The vacuum pump of claim 1 wherein said bearings are slide fitted to said end walls and interference fitted to said rotor/drive shaft combination.

4. The vacuum pump of claim 1 wherein said loaded spring is mounted between the axial stop of said one of said end walls and one of said bearings.

5. The vacuum pump of claim 1 wherein said at least one of said end walls and said rotor comprise, at oppositely facing surfaces, a plurality of annular recesses and ribs, respectively, so as to define an axial labyrinth seal between said at least one of said end walls and said rotor.

6. The vacuum pump of claim 1 wherein said other one of said end walls and said rotor comprise, at oppositely facing surfaces, an annular recess and an annular rib, respectively, said rib and recess being interengaging so as to define a radial clearance and an axial seal, respectively, between said other one of said end walls and said rotor.

7. The vacuum pump of claim 1 wherein one of said end walls comprises an inner annular rib for axially guiding said plurality of vanes when sliding substantially radially within said slots.

8. The vacuum pump of claim 1 wherein said plurality of longitudinally extending radial slots are extending along the complete longitudinal extension of said rotor.

9. The vacuum pump of claim 1 wherein the casing and one of said end walls are an integrated single detail.

10. The vacuum pump of claim 1 wherein said bearings are ball bearings.

11. The vacuum pump of claim 1 comprising a motor and a coupling, which generates axial forces, wherein said motor, via said coupling, is arranged for driving the rotor/drive shaft combination.

12. The vacuum pump of claim 11 wherein the drive shaft is provided with an axle spindle, to which said coupling is mounted.

13. The vacuum pump of claim 7 wherein said inner annular rib is provided with a through hole for lubrication of said plurality of vanes.

14. The vacuum pump of claim 13 wherein said plurality of vanes, said fluid inlet port, and said through hole for lubrication, are arranged circumferentially such that there are, at all times during operation, at least two of said plurality of vanes located between said fluid inlet port and said through hole for lubrication.

15. The vacuum pump of claim 1 wherein said plurality of longitudinally extending radial slots are at least partly radially sealed at the longitudinal ends thereof.

16. The vacuum pump of claim 15 wherein said plurality of longitudinally extending radial slots are completely radially sealed at the longitudinal ends thereof.

* * * * *